US008165503B2

(12) United States Patent
Maeda

(10) Patent No.: US 8,165,503 B2
(45) Date of Patent: Apr. 24, 2012

(54) IMAGE FORMING APPARATUS AND LIQUID DEVELOPER HOLDING MEMBER INCLUDING A CORE MEMBER AND A DIELECTRIC LAYER WITH CONCAVE PORTIONS PROVIDED ON AN OUTER CIRCUMERENCE OF THE CORE MEMBER

(75) Inventor: Masataka Maeda, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 447 days.

(21) Appl. No.: 12/406,468

(22) Filed: Mar. 18, 2009

(65) Prior Publication Data

US 2009/0245875 A1 Oct. 1, 2009

(30) Foreign Application Priority Data

Mar. 27, 2008 (JP) ..... 2008-083988

(51) Int. Cl.
*G03G 15/10* (2006.01)

(52) U.S. Cl. ..... 399/240; 399/241

(58) Field of Classification Search ..... 399/240, 399/241

See application file for complete search history.

(56) References Cited

U.S. PATENT DOCUMENTS

| | | | | |
|---|---|---|---|---|
| 5,790,930 | A * | 8/1998 | Fuchiwaki | 399/302 |
| 5,978,638 | A * | 11/1999 | Tanaka et al. | 399/302 |
| 6,038,421 | A * | 3/2000 | Yoshino et al. | 399/239 |
| 7,020,420 | B2 * | 3/2006 | Berg et al. | 399/239 |
| 2006/0062611 | A1 * | 3/2006 | Ohishi | 399/328 |

FOREIGN PATENT DOCUMENTS

| | | |
|---|---|---|
| JP | 2002-278295 A | 9/2002 |
| JP | 2006-178224 | 7/2006 |
| JP | 2007-025185 A | 2/2007 |

OTHER PUBLICATIONS

JP Office Action dtd Nov. 10, 2009, JP Appln. 2008-083988, English translation.

* cited by examiner

*Primary Examiner* — David Gray
*Assistant Examiner* — Joseph S Wong
(74) *Attorney, Agent, or Firm* — Banner & Witcoff, Ltd.

(57) ABSTRACT

An image forming apparatus includes a liquid developer holding member and a bias voltage applying unit. The liquid developer holding member includes a conductive core member and a dielectric layer provided on an outer circumference of the core member, and the dielectric layer includes a dielectric material and has at least one concave portion formed on a surface thereof. The at least one concave portion of the dielectric layer holds therein a liquid developer containing a solid developer dispersed in a carrier liquid.

15 Claims, 7 Drawing Sheets

IMAGE FORMING APPARATUS AND LIQUID DEVELOPER HOLDING MEMBER INCLUDING A CORE MEMBER AND A DIELECTRIC LAYER WITH CONCAVE PORTIONS PROVIDED ON AN OUTER CIRCUMERENCE OF THE CORE MEMBER

CROSS-REFERENCE TO RELATED APPLICATION

This application claims the benefit of Japanese Patent Application No. 2008-083988 filed Mar. 27, 2008 in the Japan Patent Office, the disclosure of which is incorporated herein by reference.

BACKGROUND

This invention relates to an image forming apparatus using a liquid development method.

In a conventional image forming apparatus using a liquid development method, an anilox roller has been proposed as a member for supplying a liquid developer to a developing roller. The anilox roller has a structure in which concave portions (grooves or holes referred to as cells) for holding the liquid developer are engraved on an outer circumferential surface thereof.

The anilox roller generally has high stiffness and metal material, for example, is preferable for the anilox roller.

SUMMARY

In an image forming apparatus using a liquid development method, a bias voltage may be applied to an anilox roller in order to facilitate transfer of a solid developer (toner particles), which is contained in a liquid developer held on the anilox roller, to a member to be supplied with the solid developer (e.g. a developing roller; hereinafter also referred to as a supply destination member).

By way of example, when the liquid developer containing positive electric toner particles is to be supplied from the anilox roller to the developing roller, a bias voltage which is higher than an electric potential of the developing roller is applied to the anilox roller. Then, the positive electric toner particles are repelled or attracted in a same direction as that of an electric field and, therefore, the positive electric toner particles held on the anilox roller are easily transferred to the developing roller.

In some cases, however, when such a bias voltage is applied to the anilox roller, the solid developer is densified in the liquid developer held on the supply destination member in such a manner that the solid developer forms a pattern corresponding to concave portions of the anilox roller. Therefore, when an electrostatic latent image is developed with the developing roller on which the solid developer is held in such a densified state, the above-described pattern is transferred onto a developed image as well, which leads to a problem that unevenness occurs on a finally obtained image, thus adversely affecting an image quality.

More specifically, for example, when grooves are formed on an outer circumference of the anilox roller in a spiral manner along a rotation axis of the anilox roller, a striped pattern having the same shape as the grooves on the anilox roller may be transferred onto a finally obtained image. Consequently, even when a solid black image is to be formed, unevenness may occur on a portion which should be solid black, and the striped pattern may be observed thereon.

According to one aspect of the present invention, an image forming apparatus may preferably restrain a solid developer contained in a liquid developer from being densified along at least one concave portion formed on a surface of a liquid developer holding member when a bias voltage is applied to the liquid developer holding member.

An image forming apparatus according to a first aspect of the present invention includes a liquid developer holding member and a bias voltage applying unit. The liquid developer holding member includes a conductive core member and a dielectric layer provided on an outer circumference of the core member, and the dielectric layer includes a dielectric material and has at least one concave portion formed on a surface thereof. The at least one concave portion of the dielectric layer holds therein a liquid developer containing a solid developer dispersed in a carrier liquid.

The bias voltage applying unit applies a bias voltage to the core member of the liquid developer holding member.

In this image forming apparatus, lines of electric force which form an electric field generated by the bias voltage are perpendicular to a surface of the core member of the liquid developer holding member on the surface of the core member, while being refracted at an interface between the core member and the dielectric layer. The lines of electric force are further refracted at an interface between the dielectric layer and the liquid developer.

Accordingly, this image forming apparatus may restrain the solid developer from being densified along the at least one concave portion when the lines of electric force are so refracted as to restrain the solid developer from being densified along the at least one concave portion.

A liquid developer holding member according to a second aspect of the present invention includes a conductive core member and a dielectric layer.

The dielectric layer is provided on an outer circumference of the core member, includes a dielectric material, and has at least one concave portion formed on a surface thereof. The core member includes at least one convex portion which is formed on the outer circumference thereof and projects toward a bottom of the at least one concave portion of the dielectric layer.

When a bias voltage is applied to the core member of such a liquid developer holding member, lines of electric force which form an electric field generated by the bias voltage are perpendicular to a surface of the at least one convex portion of the core member in a vicinity of the at least one convex portion. In other words, the lines of electric force proceed along a direction spreading outwardly from a center of the at least one convex portion. On the other hand, the lines of electric force which are perpendicular to the surface of the at least one convex portion in the vicinity of the at least one convex portion are refracted at an interface between the at least one convex portion and the dielectric layer, and further refracted at an interface between the dielectric layer and the liquid developer.

Consequently, densification of the solid developer along the at least one concave portion may be restrained by forming the at least one convex portion of the core member and the at least one concave portion of the dielectric layer in such a manner as to form the lines of electric force which restrain densification of the solid developer along the at least one concave portion.

BRIEF DESCRIPTION OF THE DRAWINGS

The present invention will now be described below, by way of example, with reference to the accompanying drawings, in which.

DETAILED DESCRIPTION OF THE PREFERRED EMBODIMENTS

[Configuration of the Entire Image Forming Apparatus]

Figure 1:
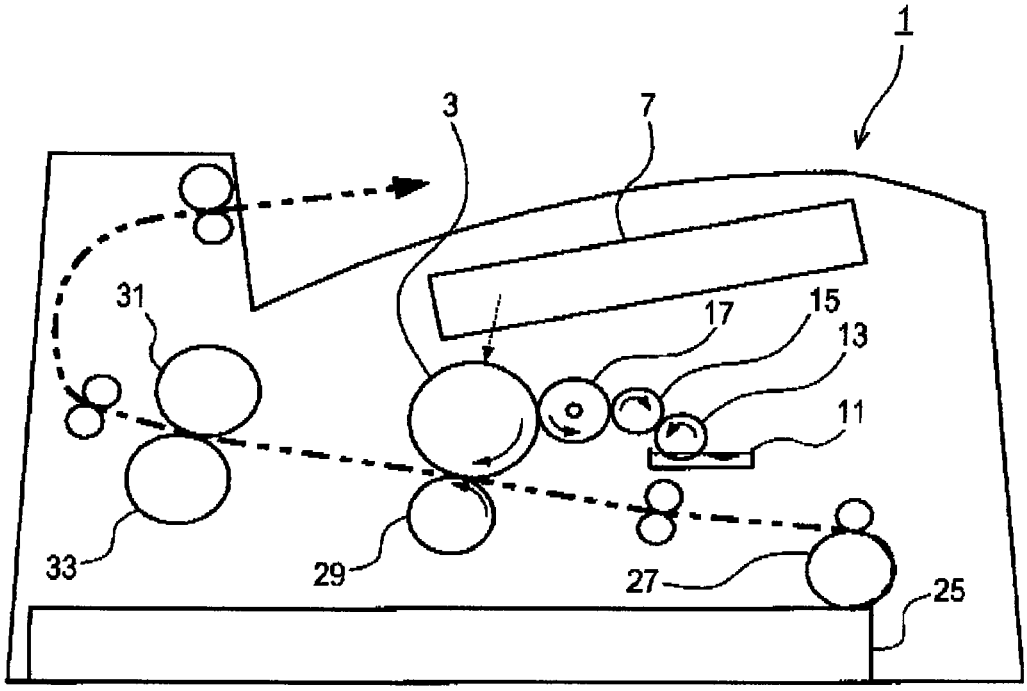
FIG. 1 is a longitudinal sectional view showing a schematic structure of an image forming apparatus exemplified as one embodiment of the present invention.

As shown in FIG. 1, an image forming apparatus 1 includes a photoconductor 3, a laser scanner 7, a liquid developer container 11, a supply roller 13, an anilox roller 15, a developing roller 17, a sheet cassette 25, a sheet feed roller 27, a transfer roller 29, a heat roller 31, a pressure roller 33, and the like.

The photoconductor 3 is a drum-shaped organic photoconductor, an outer circumferential surface of which is an image carrying surface for holding a latent image. The photoconductor 3 is so supported as to rotate in a predetermined direction (shown by an arrow in FIG. 1) driven by a motor (not shown).

The laser scanner 7 emits a laser beam (shown by a dotted arrow in FIG. 1) onto the image carrying surface of the photoconductor 3, based on data representing an image (e.g. data inputted from a personal computer, etc.) to form an electrostatic latent image on the image carrying surface of the photoconductor 3.

The liquid developer container 11 accommodates therein a liquid developer that is supplied to the developing roller 17 via the supply roller 13 and the anilox roller 15. In the present embodiment, the liquid developer contains a silicone oil as a carrier liquid, and includes a positive electric solid developer (toner particles) dispersed in the silicone oil.

The supply roller 13 is driven to rotate in a predetermined direction (shown by an arrow in FIG. 1) and supply the liquid developer from the liquid developer container 11 to the anilox roller 15 while holding the liquid developer on its outer circumferential surface.

The anilox roller 15 includes concave portions on its outer circumferential surface to hold therein a predetermined amount of the liquid developer, and is driven to rotate in a predetermined direction (shown by an arrow in FIG. 1). Via the anilox roller 15, a uniform amount of the liquid developer is supplied to the developing roller 17.

The developing roller 17 develops a latent image formed on the image carrying surface of the photoconductor 3 using the liquid developer held on an outer circumferential surface of the developing roller 17. The developing roller 17 is also driven to rotate in a predetermined direction (shown by an arrow in FIG. 1). The photoconductor 3 rotates as the developing roller 17 rotates, and the entire image carrying surface of the photoconductor 3 makes contact with the entire developer holding surface of the developing roller 17 through this rotation.

The sheet feed roller 27 feeds individual sheets or recording media held in the sheet cassette 25 to a feeding path (indicated by a double dotted line in FIG. 1).

The transfer roller 29 cooperates with the photoconductor 3 to sandwich the sheet fed to the feeding path by the sheet feed roller 27 and transfer a developed image (e.g. a solid developer image) on the photoconductor 3 to the sheet.

The sheet containing the solid developer image is sandwiched between the heat roller 31 and the pressure roller 33. The rollers 31 and 33 then apply heat and pressure to the sheet so that the solid developer image is fixed to the sheet.

[Configuration of the Anilox Roller]

A configuration of the anilox roller 15 will be described in more detail.

Figure 2A:
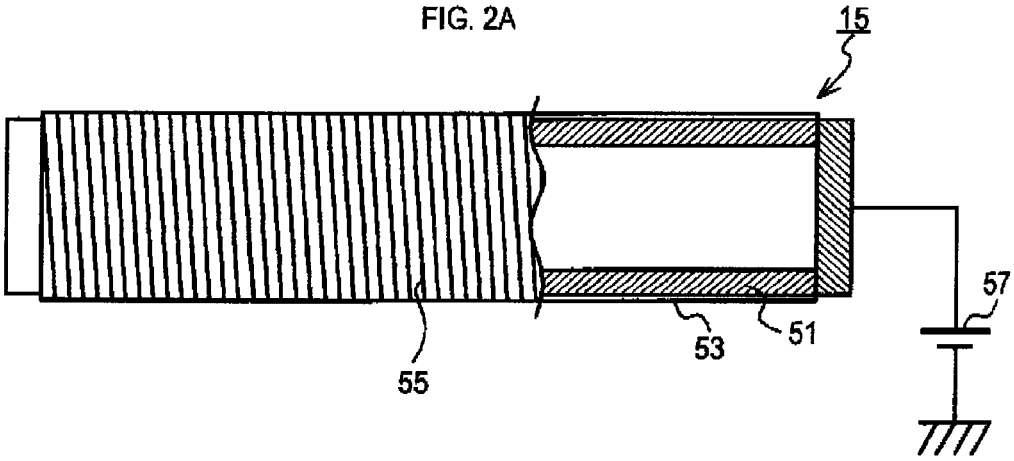
FIG. 2A is an explanatory diagram showing a schematic structure of an anilox roller.
Figure 2B:
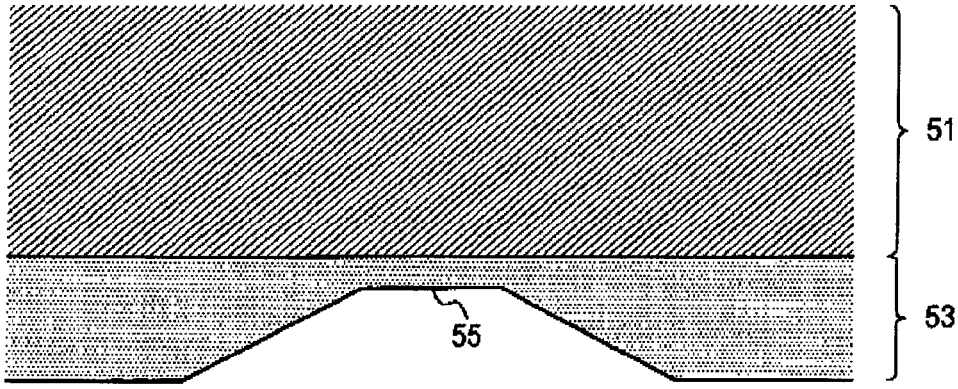
FIG. 2B is an enlarged sectional view showing a core member and a dielectric layer of the anilox roller.

In the anilox roller according to the present embodiment, a dielectric layer 53 made of a dielectric material is formed on an outer circumference of a core member 51 of metal material as shown in FIG. 2A. And a concave portion 55 is formed on a surface of the dielectric layer 53 as shown in FIG. 2B. A predetermined bias voltage is applied to the core member 51 by a bias voltage applying unit 57 when the image forming apparatus 1 is in operation. More specifically, the bias voltage is set to higher than an electric potential of the developing roller 17, that is, so set (+200 VDC in the present embodiment) as to form an electric field which facilitates transfer of the solid developer from the anilox roller 15 to the developing roller 17. In other words, the solid developer is repelled or attracted from the anilox roller 15 to the developing roller 17 according to a direction of the electric field generated by the bias voltage.

The dielectric layer 53 is made of a dielectric material with a lower permittivity than that of the carrier liquid. The dielectric material may be altered depending on a type of the carrier liquid. As specific examples of the dielectric materials with a lower permittivity than that of the carrier liquid, in a case, for example, where a silicone oil with relative permittivity of 2.8 is used as a carrier liquid, PTFE (polytetrafluoroethylene), PFA (tetrafluoroethylene-perfluoroalkylvinyl ether copolymer), and the like with a relative permittivity of 2.1 or less are preferable to form the dielectric layer 53.

The concave portion 55 is formed on the surface of the dielectric layer 53 in a spiral manner along a rotation axis of the anilox roller 15 (along a longitudinal direction of the anilox roller 15), and is specified to have such a depth that a bottom thereof does not reach the core member 51 as is enlargedly shown in FIG. 2B.

[With Respect to Effects of the Dielectric Layer]

Effects of the dielectric layer 53 will be now described.

Figure 3:
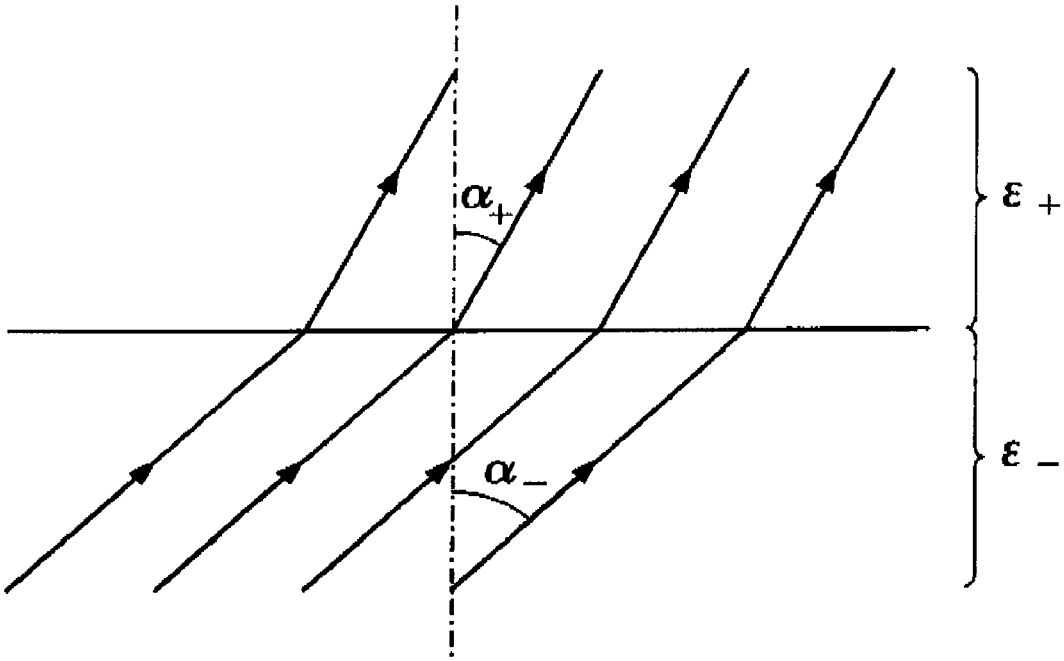
FIG. 3 is an explanatory diagram showing refraction of lines of electric force at an interface between materials with different dielectric constants.

Generally, it is known that when two materials with different permittivities are in contact with each other, lines of electric force passing through an interface between both the materials are refracted. Specifically, for example, as shown in FIG. 3, in a case where two materials with different permittivities of $\epsilon+$ and $\epsilon-$ (where $\epsilon+<\epsilon-$) are in contact with each other, the lines of electric force are refracted at angles of $\alpha+$ and $\alpha-$, which meet the following formula (1).

$$\tan \alpha+/\tan \alpha-=\epsilon+/\epsilon- \quad (1)$$

On the other hand, on a surface of a conductive material such as metal material, lines of electric force proceed in a direction perpendicular to a surface of the conductive material. Therefore, as shown in FIG. 4A, when a concave portion 65 is formed on a surface of a metal anilox roller 63, the lines of electric force proceed along curves shown in FIG. 4A within a liquid developer 71 sandwiched between the anilox roller 63 and the developing roller 17.

Figure 4A:
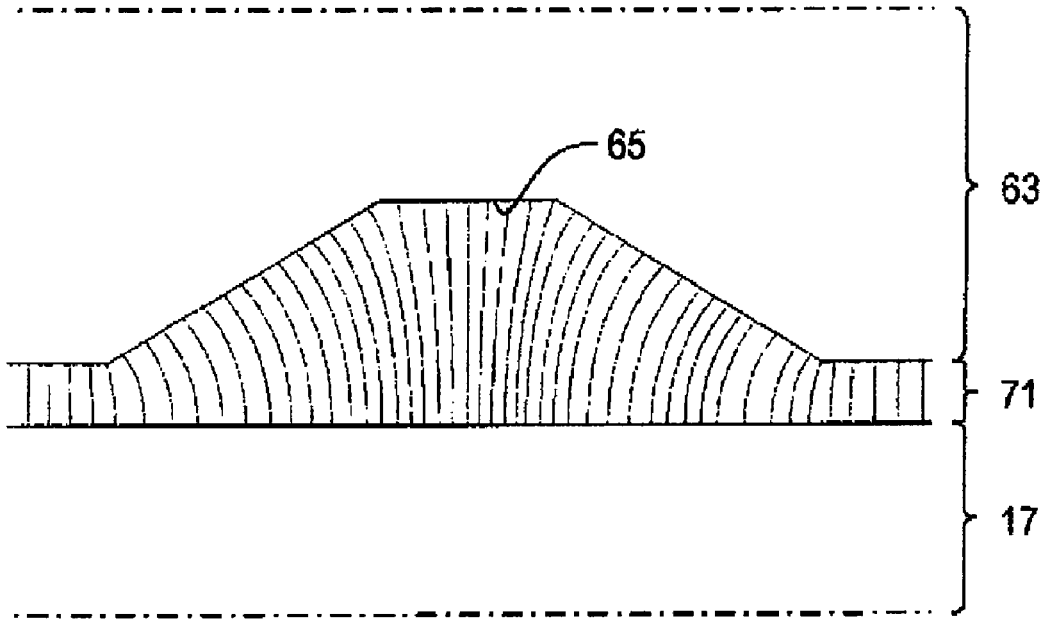
FIG. 4A is an explanatory diagram showing lines of electric force between an anilox roller and a developing roller in a case where a concave portion is formed on a surface of the anilox roller.

In this case, the solid developer contained in the liquid developer 71 is transferred to a side of the developing roller 17 along the lines of electric force shown in FIG. 4A and, therefore, the solid developer present inside the concave portion 65 is gathered to the center of the concave portion 65. As a result, a density of the solid developer is likely to be increased in the vicinity of the center of the concave portion 65, and contrarily, decreased therearound, which leads to a problem that a pattern with the same shape as the concave portion 65 is transferred to the developing roller 17.

Figure 4B:
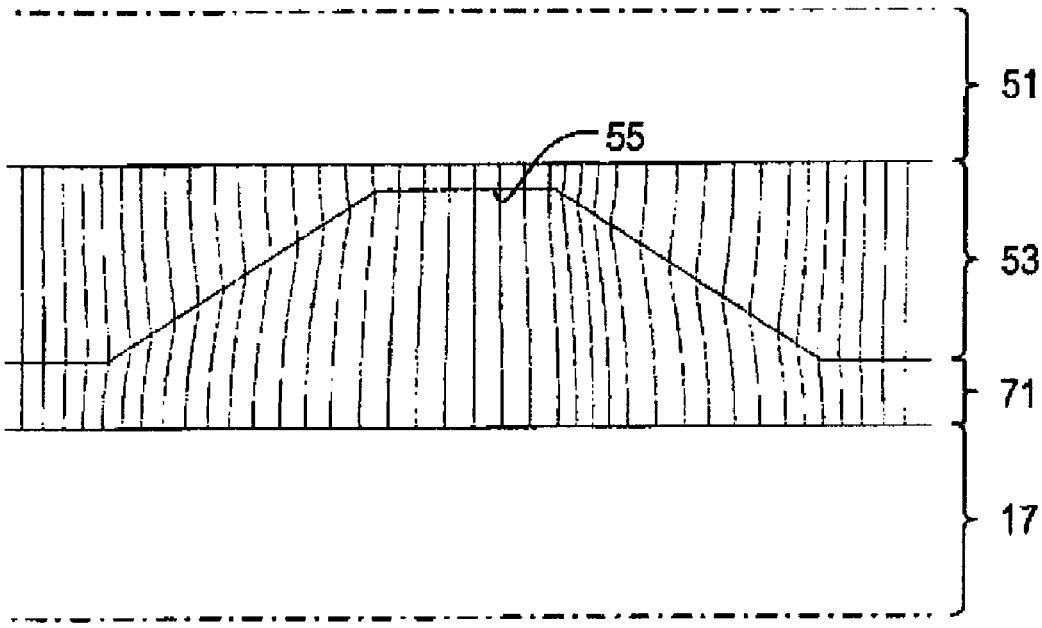
FIG. 4B is an explanatory diagram showing lines of electric force between an anilox roller and a developing roller in a case where a concave portion is formed on a surface of a dielectric layer.

In contrast, in the anilox roller 15 adopted in the image forming apparatus 1, lines of electric force proceed along curves shown in FIG. 4B within the liquid developer 71 sandwiched between the anilox roller 15 and the developing roller 17.

That is to say, although the anilox roller 15 includes the core member 51 of metal material, the surface profile of the core member 51 is arbitrarily determined so as to make it less likely to cause densification of the solid developer, because the concave portion is not necessary to be formed on the core member 51. Therefore, for example, by allowing the core member 51 to be cylindrical in shape with no concave portion, the lines of electric force proceed perpendicularly to a cylindrical surface of the core member 51.

In addition, the lines of electric force are so refracted as to spread outwardly from the center of the concave portion 55 at the point where the lines of electric force pass through an interface between the dielectric layer 53 and the liquid developer 71, due to the relationship ($\epsilon+<\epsilon-$) between the permittivity $\epsilon+$ of the dielectric layer 53 and the permittivity $\epsilon-$ of the carrier liquid which is a dispersion medium in the liquid developer 71.

As a result, in this case, the solid developer contained in the liquid developer 71 is transferred to the side of the developing roller 17 along the lines of electric force shown in FIG. 4B and, therefore, the solid developer present inside the concave portion 55 is not gathered to the center of the concave portion 56. As a result, it is possible to restrain the density of the solid developer from being increased in the vicinity of the center of the concave portion 55, and at the same time, from being decreased therearound.

Accordingly, when the anilox roller 15 provided with such a dielectric layer 53 is used, it is possible to restrain transfer of the pattern with the same shape as the concave portion 55 to the developing roller 17, which is different from the case in which the metal anilox roller 63 is used. And, eventually, it is possible to restrain unevenness with the same shape as the concave portion 55 from occurring on a finally obtained image.

As described above, the densification of the solid developer resulting from the concave portion of the anilox roller may be restrained by forming the concave portion 55 in the dielectric layer 53. This densification-restraining effect may be improved either by lowering the permittivity of the dielectric layer 53 smaller than that of the above-described dielectric layer 53 or by raising the permittivity of the carrier liquid in the liquid developer 71 greater than that of the above-described carrier liquid.

Figure 5A:
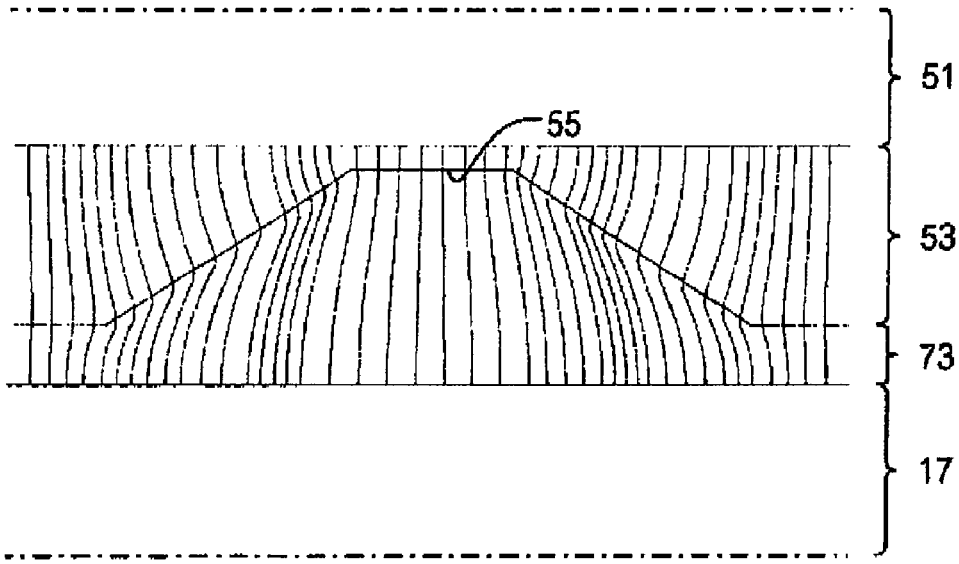
FIG. 5A is an explanatory diagram showing lines of electric force between an anilox roller and a developing roller in a case where a liquid developer contains a carrier liquid with a relative permittivity higher than that of a carrier liquid contained in a liquid developer in FIG. 4B.

For example, FIG. 5A shows lines of electric force when a liquid developer 73 contains a carrier liquid with a higher relative permittivity than that in the case shown in FIG. 4B. As can be seen in FIG. 5A, when the relative permittivity of the carrier liquid is increased, the lines of electric force are so refracted as to spread more outwardly from the center of the concave portion 55. Accordingly, when the solid developer spreads in the direction along such lines of electric force, the densification-restraining effect on the solid developer will be improved.

Figure 5B:
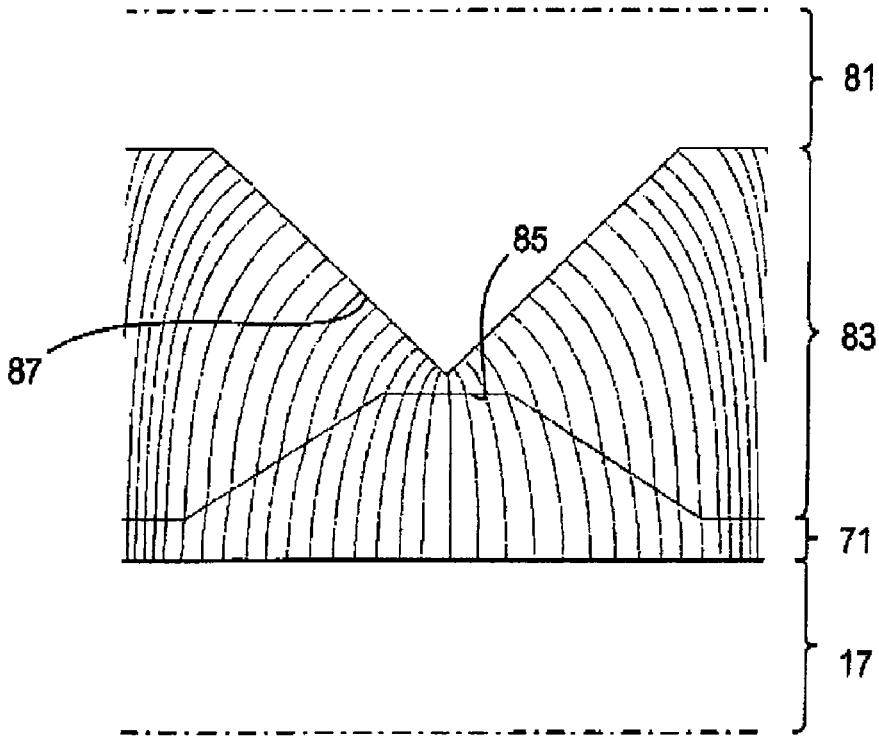
FIG. 5B is an explanatory diagram showing lines of electric force between an anilox roller and a developing roller in a case where a convex portion is formed on a surface of a core member.

Though the core member 51 is exemplified as cylindrical in shape in FIG. 4B, a dielectric layer 83 may be provided on an outer circumference of a metal core member 81, and convex portion 87 projecting toward the bottom of a concave portion 85 may be formed on the outer circumference of the metal core member as exemplified in FIG. 5B.

By providing such a convex portion 87, lines of electric force spread outwardly from the center of the convex portion 87 since the lines of electric force proceed in a direction perpendicular to a convex surface of the convex portion 87. Although the lines of electric force spreading outwardly from the center of the convex portion 87 are so refracted at an interface between the convex portion 87 and the dielectric layer 83 as to converge toward each other, and further refracted at an interface between the dielectric layer 83 and the liquid developer 71 as to further converge toward each other, densification of the solid developer along the concave portion 85 is restrained.

Modified Embodiment Etc.

Although the embodiments of the present invention have been described thus far, the present invention is not limited to the specific embodiments described above, but may be implemented in various embodiments other than the above.

Figure 6:
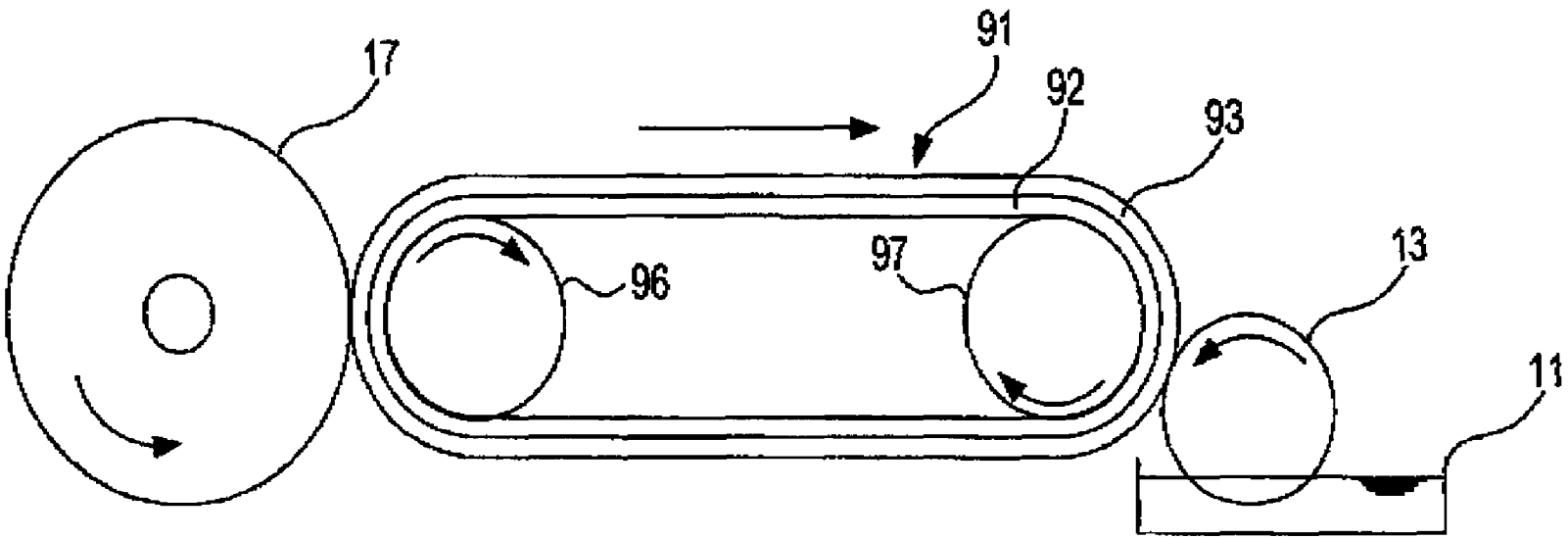
FIG. 6 is a longitudinal sectional view showing a schematic structure of an essential part of an image forming apparatus according to one modified embodiment.

For example, in the above embodiments, an endless belt 91 shown in FIG. 6 can be provided in place of the anilox roller 15. The endless belt 91 is looped between a pair of driving rollers 96 and 97, and includes a conductive core belt 92 and a dielectric belt 93, provided on an outer circumference of the core belt 92, including a dielectric material.

Figure 7A:
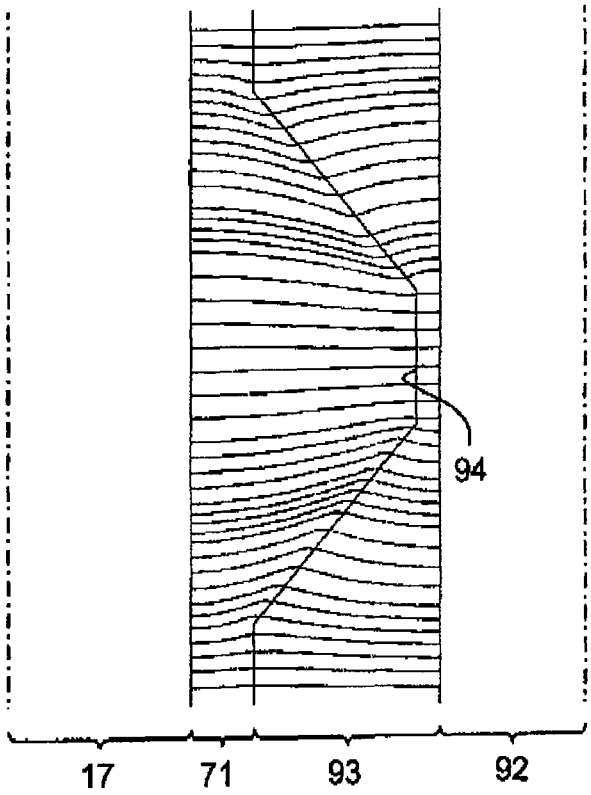
FIG. 7A is an explanatory diagram showing lines of electric force between an endless belt and a developing roller in a case where an outer circumferential surface of a core belt of the endless belt is flat.
Figure 7B:
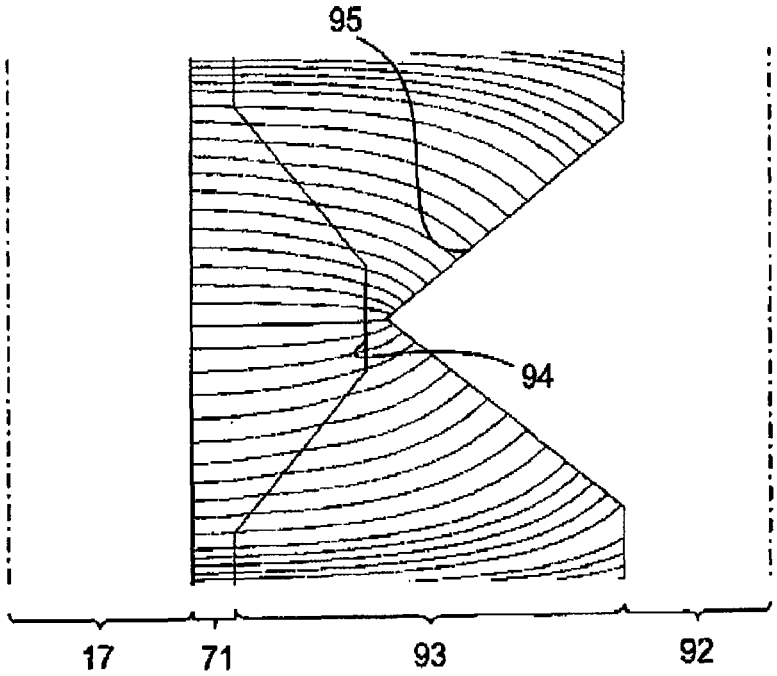
FIG. 7B is an explanatory diagram showing lines of electric force between an endless belt and a developing roller in a case where an outer circumferential surface of a core belt of the endless belt has a convex portion.

On an outer circumferential surface of the dielectric belt 93, a concave portion 94 is provided as shown in FIGS. 7A and 7B. In contrast, the outer circumferential surface of the core belt 92 may be flat as shown in FIG. 7A or may have a convex portion projecting toward a bottom of the concave portion 94 as shown in FIG. 7B. A bias voltage may be applied to an inner circumferential surface of the core belt 92 directly from the bias voltage applying unit 57, or via an outer circumferential surface of at least one of the driving rollers 96 and 97.

The above-described endless belt 91 may function in a similar manner as the anilox roller 15 according to the above embodiments.

Furthermore, though in the above embodiments, the developing roller 17 is exemplified as a supply destination member, the anilox roller may supply the liquid developer to a member other than the developing roller.

Specifically, the anilox roller itself may function as a developing roller, which supplies the liquid developer to the photoconductor. Alternatively, between the anilox roller and the developing roller, an intermediate roller may be interposed, to which the liquid developer is supplied by the anilox roller. Furthermore, the anilox roller may supply the liquid developer not only to these rollers such as a developing roller and an intermediate roller, but also to the supply destination member of an endless belt shape.

In addition, though in the above embodiments, the concave portion 55 which is formed in a spiral manner on the outer circumference of the anilox roller 15 is exemplified, the configuration of the concave portion is not limited to be spiral. For example, a plurality of ring-shaped concave portions surrounding an outer circumference of the anilox roller 15 may be formed parallel to each other. Alternatively, mesh-shaped concave portions may be formed by forming spiral grooves which intersect with each other. Besides that, a plurality of non-penetrating holes may be arranged as concave portions, which may be holes with arbitrary shape such as circular holes, quadrilateral holes, hexagonal holes, and the like.

Furthermore, though in the above embodiments, the liquid developer containing the positive electric solid developer dispersed in the carrier liquid is exemplified, a liquid developer containing a negative electric solid developer dispersed in a carrier liquid may be employed. In this case, lower bias voltage may be applied to the anilox roller than electric potential of the developing roller.

What is claimed is:

1. An image forming apparatus comprising:

a liquid developer holding member including a conductive core member and a dielectric layer provided on an outer circumference of the core member, the dielectric layer including a dielectric material and having at least one concave portion formed on a surface thereof, the at least one concave portion configured to hold a liquid developer that develops a latent image held on an image carrying member, and the liquid developer containing a solid developer dispersed in a carrier liquid; and a bias voltage applying unit configured to apply a bias voltage to the core member of the liquid developer holding member, wherein a permittivity of the dielectric material is lower than a permittivity of the carrier liquid.

2. The image forming apparatus according to claim 1, wherein the bias voltage is a voltage for generating an electric field which facilitates separation of the solid developer from the liquid developer holding member.

3. The image forming apparatus according to claim 1, wherein at least one convex portion projecting toward a bottom of the at least one concave portion is formed on the outer circumference of the core member.

4. The image forming apparatus according to claim 1, wherein the liquid developer holding member is in a form of a roller.

5. The image forming apparatus according to claim 1, wherein the liquid developer holding member is in a form of a belt.

6. The image forming apparatus according to claim 1, further comprising a supply destination member to which the liquid developer is supplied by making contact with the surface of the dielectric layer of the liquid developer holding member.

7. The image forming apparatus according to claim 6, wherein the supply destination member is in a form of a roller.

8. The image forming apparatus according to claim 6, wherein the supply destination member is a developing roller which develops the latent image with the liquid developer by making contact with the image carrying member holding thereon the latent image.

9. The image forming apparatus according to claim 1, wherein relative permittivity of the carrier liquid is 2.8.

10. The image forming apparatus according to claim 1, wherein relative permittivity of the dielectric layer of the liquid developer holding member is 2.1 or less.

11. The image forming apparatus according to claim 1, wherein the dielectric layer of the liquid developer holding member includes at least one of polytetrafluoroethylene and tetrafluoroethylene-perfluoroalkylvinyl ether copolymer.

12. A liquid developer holding member comprising:

a conductive core member; and a dielectric layer provided on an outer circumference of the core member, the dielectric layer including a dielectric material and having at least one concave portion formed on a surface thereof;

the core member including at least one convex portion formed on the outer circumference thereof and projecting toward a bottom of the at least one concave portion of the dielectric layer.

13. The liquid developer holding member according to claim 12, the liquid developer holding member is in a form of a roller.

14. The liquid developer holding member according to claim 12, the liquid developer holding member is in a form of a belt.

15. An image forming apparatus comprising:

a liquid developer holding member including a conductive core member and a dielectric layer provided on an outer circumference of the core member, the dielectric layer comprising a dielectric material and having at least one concave portion formed on a surface thereof, the at least one concave portion holding a liquid developer containing a solid developer dispersed in a carrier liquid; and a bias voltage applying unit configured to apply a bias voltage to the core member of the liquid developer holding member, wherein at least one convex portion projecting toward a bottom of the at least one concave portion is formed on the outer circumference of the core member.

* * * * *